US008158912B2

(12) United States Patent
Armstrong et al.

(10) Patent No.: US 8,158,912 B2
(45) Date of Patent: Apr. 17, 2012

(54) FAN APPARENCY ARRANGEMENT FOR AN APPLIANCE

(75) Inventors: James Armstrong, Louisville, KY (US); Steve B. Froelicher, Shepherdsville, KY (US); Cheng Qiang Ren, Louisville, KY (US); Christopher Mast, Louisville, KY (US)

(73) Assignee: General Electric Company, Schenectady, NY (US)

( * ) Notice: Subject to any disclaimer, the term of this patent is extended or adjusted under 35 U.S.C. 154(b) by 891 days.

(21) Appl. No.: 12/188,414

(22) Filed: Aug. 8, 2008

(65) Prior Publication Data

US 2010/0031949 A1 Feb. 11, 2010

(51) Int. Cl.

| | |
|---|---|
| ***A21B 1/40*** | (2006.01) |
| ***A21B 1/26*** | (2006.01) |
| ***A21B 3/04*** | (2006.01) |
| ***F24C 15/00*** | (2006.01) |
| ***F24C 15/20*** | (2006.01) |

(52) U.S. Cl. ..... 219/400; 219/399; 126/21 R; 237/47

(58) Field of Classification Search ..... None
See application file for complete search history.

(56) References Cited

U.S. PATENT DOCUMENTS

| | | | | | |
|---|---|---|---|---|---|
| 1,796,198 | A | * | 3/1931 | Gehnrich | 34/534 |
| 3,628,346 | A | * | 12/1971 | Lagrone, Jr. | 62/126 |
| 3,776,214 | A | * | 12/1973 | Coffman | 126/113 |
| 4,489,647 | A | * | 12/1984 | Stamps et al. | 99/336 |
| 4,505,194 | A | * | 3/1985 | Bishop et al. | 99/336 |
| 4,725,700 | A | * | 2/1988 | Zoludow | 200/81.9 R |
| 4,737,103 | A | * | 4/1988 | Siccardi | 432/222 |
| 4,964,392 | A | * | 10/1990 | Bruno et al. | 126/21 A |
| 5,042,458 | A | * | 8/1991 | Spencer et al. | 126/299 R |
| 5,364,385 | A | * | 11/1994 | Harms et al. | 604/410 |
| 6,772,752 | B1 | * | 8/2004 | Boyer | 126/21 A |
| 2006/0237425 | A1 | * | 10/2006 | Kim et al. | 219/400 |

* cited by examiner

*Primary Examiner* — Joseph M Pelham
(74) *Attorney, Agent, or Firm* — Global Patent Operation; Douglas D. Zhang

(57) ABSTRACT

A fan apparency arrangement for an appliance is disclosed. The fan apparency arrangement includes a chamber having a port; a fan in the chamber for moving air out of the chamber, the fan having a discharge end, and an intake end having an intake tube; and a sail switch disposed in the intake tube. When activated, the fan moves air out of the chamber through the port and creates a pressure difference between opposite ends of the intake tube, the pressure difference causing the sail switch to change position and signal that the fan is activated. An appliance incorporating such a fan apparency arrangement is also disclosed.

14 Claims, 4 Drawing Sheets

FAN APPARENCY ARRANGEMENT FOR AN APPLIANCE

BACKGROUND OF THE INVENTION

The present invention relates generally to a fan apparency arrangement. More particularly, the present invention relates to a fan apparency arrangement for an appliance and an appliance incorporating such a fan apparency arrangement.

Appliances such as cooking ranges are widely used. A cooking range typically includes an oven. The oven typically has a front-opening access door, and at least one heating element for heating up the inside of the oven cavity. As is known in the art, when energized, the heating element can heat up the inside of the oven cavity to a relatively high cooking temperature chosen by a user. Also as is known in the art, the cooking range often has a fan which is used to cool a component of the oven, such as the front-opening access door, or a heat sensitive component of the oven such as an electrical element, to a temperature which is lower than the chosen cooking temperature. Some certification institutions, such as Underwriters Laboratories Inc. (UL), require that a fan apparency device (FAD) be employed in the cooking range. The FAD is used to determine or detect whether the fan is working properly.

As is known in the art, when a user selects or chooses a heating operation of the oven and turns on the oven, the turning-on supposedly activates the fan. The FAD then determines or detects whether the fan is working properly. If the fan is working properly, the FAD enables the selected heating operation of the oven to proceed. On the other hand, if the fan is not working properly, the FAD prevents the selected heating operation of the oven from proceeding.

Various types of FADs are used to determine or detect whether the fan is working properly. The most widely used FADs are thermal switches and sail switches. A thermal switch uses the heat from the oven to heat up a bimetal member of the switch to turn off the switch when the airflow from the fan is no longer present to cool off the bimetal member. Since the thermal switch usually is not disposed adjacent the intake end or the discharge end of the fan, it does not negatively affect the airflow passing through the fan. However, the thermal switch has a relatively slow reaction time. In addition, the thermal switch needs to be installed in an area of the oven where the temperature can raise quickly when the oven is turned on. Moreover, the thermal switch requires lots of testing to prove that it will work as intended in all working conditions of the oven.

A typical sail switch uses the airflow generated by the fan to move a sail to turn on or off the switch. Compared with the thermal switch, the sail switch has a relatively fast reaction time, and does not require lots of testing to implement. However, the sail switch has its own limits. In particular, when it is desirable to direct or point the exhaust end or discharge end of the fan toward the floor on which the appliance is placed, it will be difficult to satisfactorily employ the sail switch in this configuration. This is because in this configuration, the positive pressure side of the sail, which is positioned downstream of the fan, has to face up. As a result, the weight of the sail constantly urges the sail to move from its upper position where the sail opens the switch to its lower position where the sail closes the switch. To make matters worse, in this configuration the positive pressure side of the sail tends to collect a noticeable amount of dust particulars, grease, etc. All of these contribute to the problem that the sail may move to and stay in its lower position even when the fan is not activated, thus creating a false indication of the working condition of the fan.

BRIEF DESCRIPTION OF THE INVENTION

As described herein, the preferred embodiments of the present invention overcome one or more of the above or other disadvantages known in the art.

One aspect of the present invention relates to a fan apparency arrangement for an appliance. The fan apparency arrangement includes a chamber having a port; a fan in the chamber for moving air out of the chamber, the fan having a discharge end, and an intake end having an intake tube having an entrance and an exit; and a sail switch disposed in the intake tube. When activated, the fan moves air out of the chamber through the port and creates a pressure difference between the entrance and the exit of the intake tube, the pressure difference causing the sail switch to change position and signal that the fan is activated.

Another aspect of the present invention relates to an appliance that includes a chamber having a wall having a port; an air blower in the chamber for moving air out of the chamber, the air blower including a discharge end disposed adjacent to the port, and an intake end including an intake tube having an entrance and an exit; and a pressure switch device disposed in the intake tube between the entrance and the exit. The pressure switch device includes a switch for signaling that the air blower is activated, and a sail member movable between a first position where the sail member does not turn on the switch and a second position where the sail member turns on the switch to signal that the air blower is activated. When activated, the air blower moves air out of the chamber through the port and creates a pressure difference between the entrance and the exit of the intake tube, the pressure difference causing the sail member to move from the first position to the second position.

These and other aspects and advantages of the preferred embodiments of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE PREFERRED EMBODIMENTS OF THE INVENTION

Figure 1:
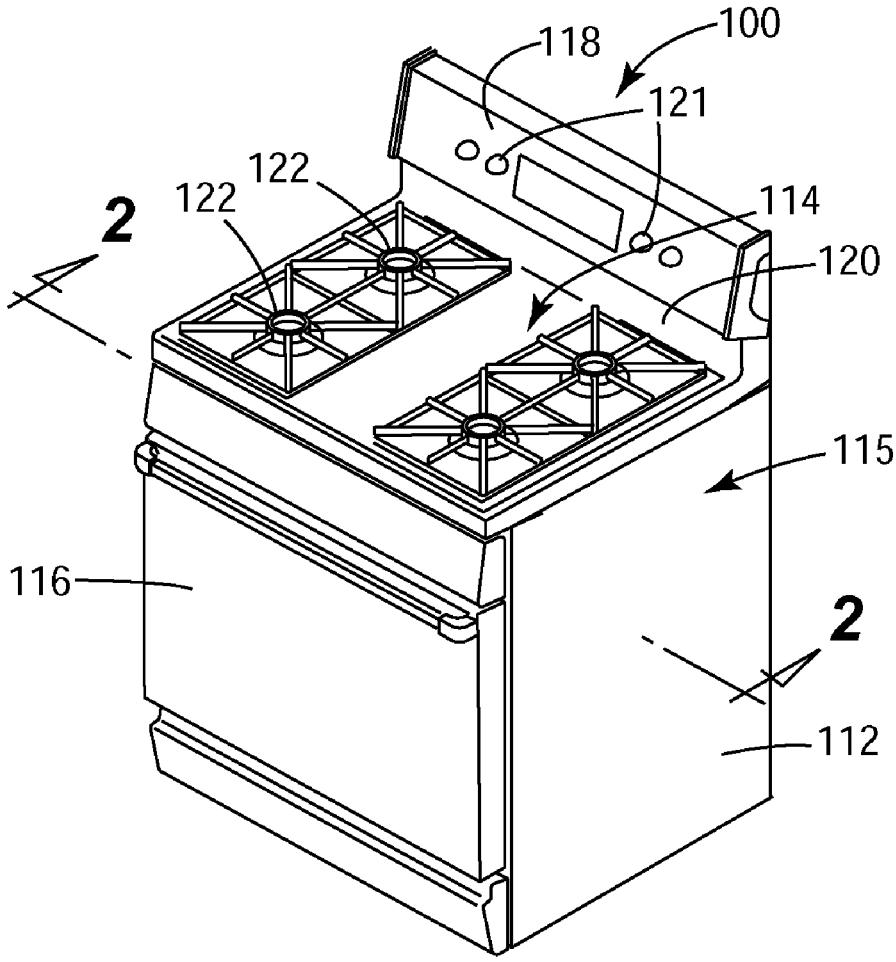
FIG. 1 is a perspective view of an exemplary cooking range incorporating a fan apparency arrangement in accordance with a preferred embodiment of the present invention.

An exemplary appliance incorporating a fan apparency arrangement in accordance with a preferred embodiment of the present invention is generally designated by reference numeral 100 in FIG. 1. By way of non-limiting example, the appliance 100 is shown as a freestanding cooking range in FIG. 1. However, the preferred embodiments of the present invention can also be used in other types of appliances such as ovens, dryers, etc.

The cooking range 100 includes an outer body or housing 112 that has a generally rectangular shaped cook top 114. An oven 115, not shown in detail, is positioned below the cook top 114 and has a front-opening access door 116 for closing the oven cavity. Preferably, an integral backsplash 118 extends upward from a rear edge 120 of the cook top 114 and contains various controls 121 for selectively operating heating elements such as gas burners 122 on the cook top 114 and heating elements (not shown) in the oven 115.

Figure 2:
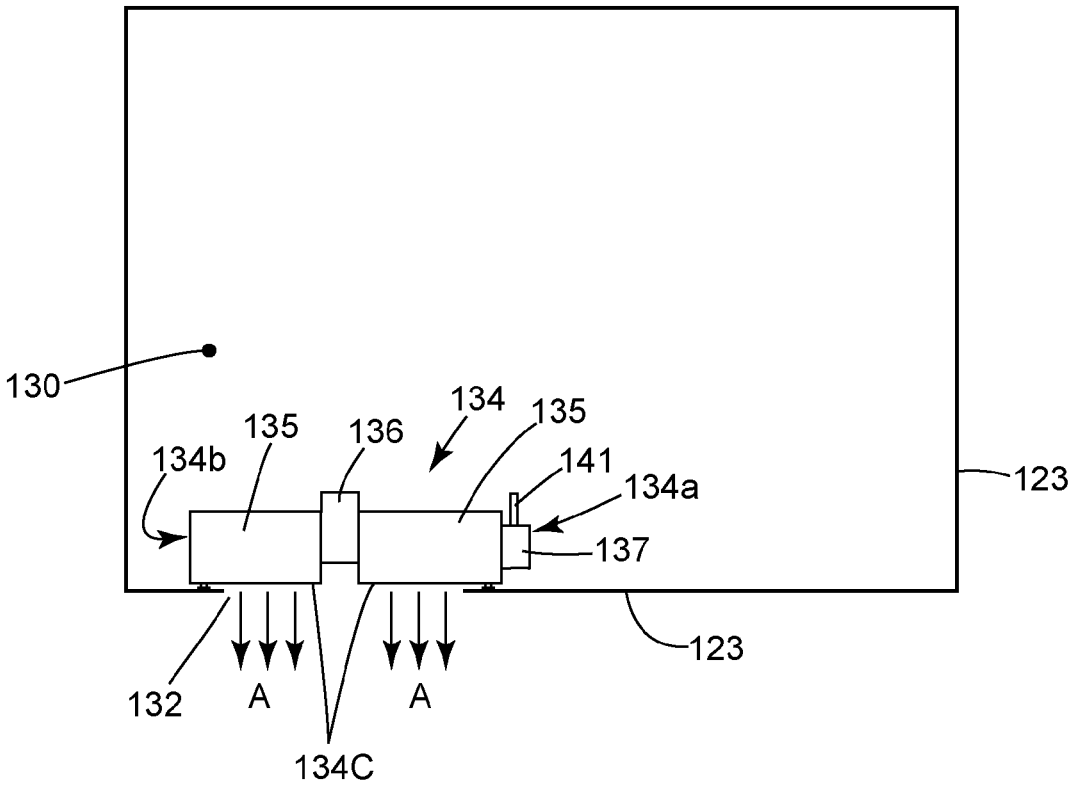
FIG. 2 is an enlarged, partial, schematic, substantially vertically cross-sectional view along lines 2-2 in FIG. 1.

As shown in FIG. 2, the wall 123 of the oven 115 defines or forms a chamber 130. As is known in the art, the chamber 130 is in fluid communication with an area of the oven 115, such as the front-opening access door 116 or an area enclosing electronic controls (not shown), that needs to be cooled off during operation. The component of the oven 115 can be in turn in fluid communication with an outside of the oven 115. The wall 123 has a port 132.

An air blower such as an electric fan 134 is arranged in the chamber 130. The fan 134 preferably has two intake ends 134*a*, 134*b*, and two discharge ends 134*c* which are disposed adjacent to the port 132 of the chamber 130. The fan 134 essentially has two blower units 135 which are coupled to each other and driven by a common motor 136. The fan 134 is a centrifugal blower type fan known in the art and therefore will not be discussed in detail here.

When activated or energized, the fan 134 blows air out of the chamber 130 through the port 132, as indicated by the arrows A in FIG. 2. As is known in the art, when the fan 134 is activated or energized, for each blower unit 135, there is a pressure difference between the intake end 134*a*, 134*b* and its corresponding discharge end 134*c*. The fan housing has two bottom or side openings (depending on the configuration; openings not shown) at the discharge ends 134*c* through which air is forced out when the fan 134 is activated.

Figure 3:
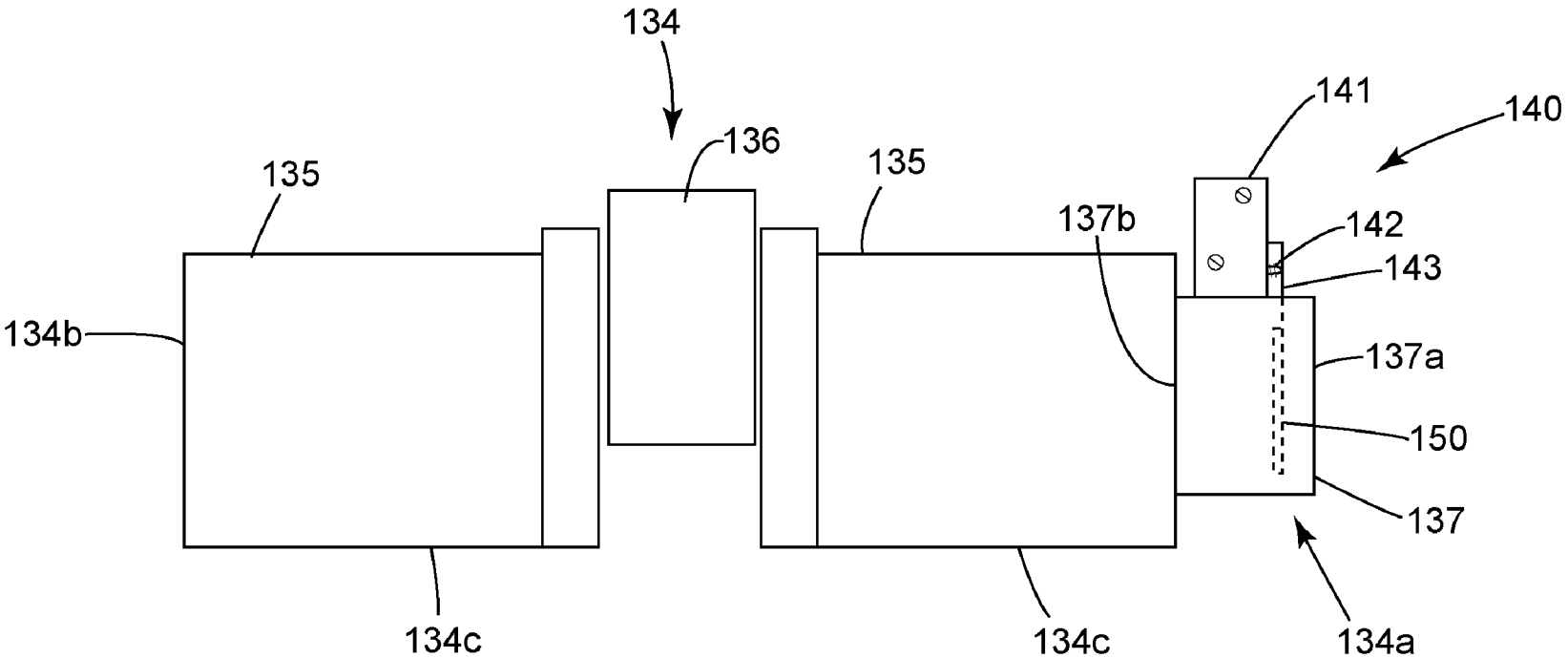
FIG. 3 is an enlarged, schematic view of the fan of the fan apparency arrangement of FIG. 1.

As shown in FIGS. 2 and 3, the intake end 134*a* includes an intake tube 137 having an entrance 137*a* and an exit 137*b*. The function of the intake tube 137 will be explained below.

Figure 5:
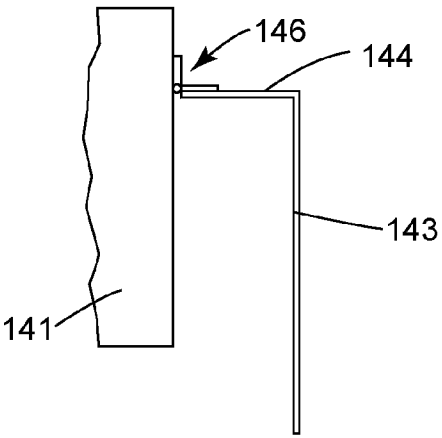
FIG. 5 is an enlarged, schematic, side view of part of the sail switch of FIG. 4, showing how the sail arm is pivotably attached to the switch housing.
Figure 6:
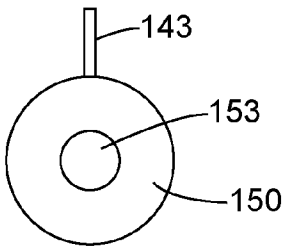
FIG. 6 is a schematic view of the sail of the sail switch from the direction B in FIG. 4.
Figure 4:
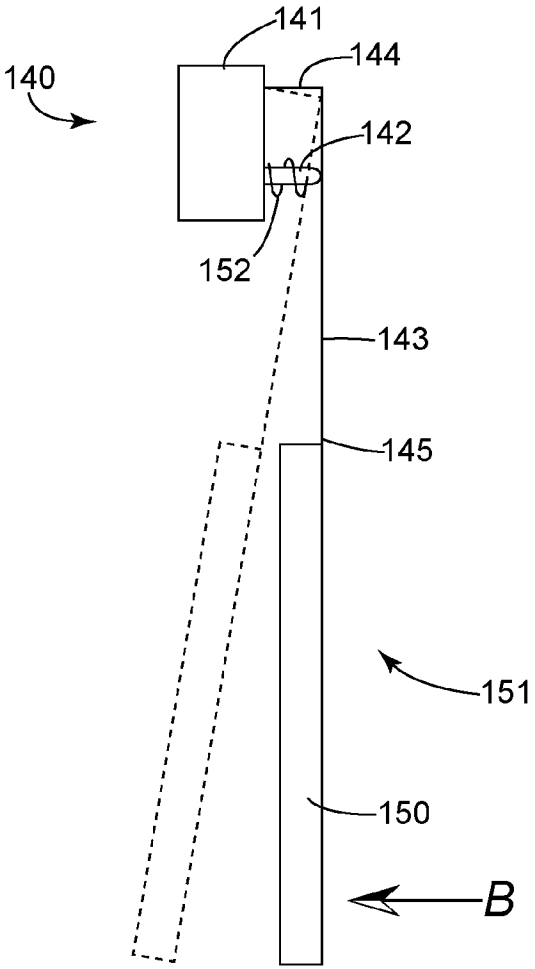
FIG. 4 is an enlarged, schematic, side view of the sail switch for the fan apparency arrangement of FIG. 3.

As shown in FIG. 3, a pressure switch device such as a sail switch 140 is disposed in the intake tube 137. The sail switch 140 includes a switch housing 141 which is supported by the intake tube 137. The switch housing 141 can be made part of the intake tube 137. Referring now to FIG. 4, the sail switch 140 also includes a lever 142 which is supported by, and movable relative to, the switch housing 141. The sail switch 140 further includes a sail arm 143, one end 144 of which is bent. The bent end 144 is pivotably attached to the switch housing 141 by for example a hinge arrangement 146 (see FIG. 5) so that the sail arm 143 can move from a substantially vertical position toward the switch housing 141. In this regard, the intake tube 137 has a corresponding opening (not shown) through which the sail arm 143 passes. Preferably the bent end 144 is positioned adjacent to the lever 142. The other end 145 of the sail arm 143 is attached to a sail 150. Preferably the sail 150 is disposed substantially transverse to the moving direction of the air passing through the intake tube 137. Moreover, preferably the sail 150 has an opening 153 or a shape so that there is a sufficient passageway between the intake tube 137 and the sail 150 for air to pass through. The sail arm 143 and the sail 150 form a sail member 151.

Preferably, the sail 150 is substantially vertically disposed by the force of gravity when the sail member 151 is in its first position. As shown in FIG. 4, an elastic member such as a compression spring 152 is arranged on the lever 142. In this configuration, one end of the compression spring 152 abuts or is against the switch housing 141. The other end of the spring 152, which is distal to the switch housing 141, is fixedly attached to the lever 142. The spring 152 is optional. While in the illustrative embodiment, the sail 150 or the sail member 151 is substantially vertically disposed when in its first position, use of the spring 152 could permit the spring 152 to hold the sail member 151 in a non-vertical position when the sail member 151 is in its first position.

When the fan 134 is not activated or energized, there is no pressure difference between the discharge end 134*c* and the intake end 134*a* or between the entrance 137*a* and the exit 137*b*. The force of gravity, aided by the spring 152 when present, keeps the sail member 151 in its first position where the lever 142 is away from the switch housing 141 and the sail switch 140 is turned off.

When the fan 134 is activated or energized, it creates low pressure in the interior of the fan as air is forced out of the side openings. This draws air into the fan 134 through the intake ends 134*a*, 134*b*, creating a pressure difference between the intake ends 134*a*, 134*b* and the interior of the fan 134, and consequently a pressure difference between the entrance 137*a* and the exit 137*b* of the intake tube 137. This pressure difference acts on the sail 150 so that the sail member 151 moves from the first position to a second position where the lever 142 is pushed toward the switch housing 141 and the sail switch 140 is turned on. If the spring 152 is used, then moving of the sail member 151 from its first position to its second position causes the sail arm 143 to overcome the urging force of the spring 152 and move or push the lever 142 toward the switch housing 141 to turn on the sail switch 140.

During operation, a user selects a heating operation for the oven 115 and activates the oven 115 by a start switch or dial (not shown). Activating the oven 115 in turn activates the fan 134. If the fan 134 works properly, the sail switch 140 is turned on and generates a signal for the controller (not shown) of the oven 115. The signal indicates that the fan is activated and enables the selected heating operation to proceed. However, if the fan 134 does not work properly, the sail switch 140 will not be turned on and will not generate the signal. The absence of the signal prevents the selected heating operation from proceeding, and the oven 115 will generate or display an error or service needed signal for the user. These are known in the art, and therefore will not be discussed further here.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A fan apparency arrangement for an appliance, comprising:

a chamber having a port;

a fan in the chamber for moving air out of the chamber, the fan comprising a discharge end, and an intake end comprising an intake tube having an entrance and an exit; and a sail switch disposed in the intake tube and comprising a sail member defining an opening configured to provide a sufficient passageway between the intake tube and the sail member for air to pass through the intake tube, wherein when activated, the fan moves air out of the chamber through the port and creates a pressure difference between the entrance and the exit of the intake tube, the pressure difference causing the sail switch to change position and signal that the fan is activated.

2. The arrangement of claim 1, wherein the sail switch further comprises a switch for signaling that the fan is activated, and the sail member is movable between a first position where the sail member does not turn on the switch and a second position where the sail member turns on the switch, the pressure difference causing the sail member to move from the first position to the second position.

3. The arrangement of claim 2, wherein the sail member comprises a sail arm having a first end pivotably supported by the intake tube and a second end opposite the first end, the sail member further comprising a sail attached to the second end of the sail arm.

4. The arrangement of claim 3, wherein when the sail member is in the second position, the sail is substantially vertically disposed.

5. The arrangement of claim 2, wherein the sail switch further comprises an elastic member urging the sail member to the first position.

6. An appliance comprising:

a chamber having a wall, the wall having a port;

an air blower in the chamber for moving air out of the chamber, the air blower comprising a discharge end disposed adjacent to the port, and an intake end comprising an intake tube having an entrance and an exit; and a pressure switch device disposed in the intake tube between the entrance and the exit and comprising:

a switch for signaling that the air blower is activated; and a sail member movable between a first position where the sail member does not turn on the switch and a second position where the sail member turns on the switch to signal that the air blower is activated, the sail member defining an opening configured to provide a sufficient passageway between the intake tube and the sail member for air to pass through the intake tube, wherein when activated, the air blower moves air out of the chamber through the port and creates a pressure difference between the entrance and the exit of the intake tube, the pressure difference causing the sail member to move from the first position to the second position.

7. The appliance of claim 6, wherein the sail member comprises a sail arm having a first end pivotably supported by the intake tube and a second end opposite to the first end, the sail member further comprising a sail attached to the second end.

8. The appliance of claim 7, wherein when the sail member is in the first position, the sail is substantially vertically disposed by force of gravity.

9. The appliance of claim 7, wherein the pressure switch device further comprises an elastic member for urging the sail member to the first position.

10. The appliance of claim 9, wherein the elastic member comprises a compression spring.

11. The appliance of claim 10, wherein the compression spring is supported by the intake tube and disposed adjacent to the first end of the sail arm.

12. The appliance of claim 11, wherein the switch comprises a lever movable relative to the intake tube, the compression spring having a first end fixedly attached to the lever and a second end disposed against the intake tube.

13. The appliance of claim 6, wherein the air blower comprises an electric fan.

14. The appliance of claim 6, wherein the air blower comprises a centrifugal type air blower.

* * * * *